United States Patent [19]

Nishio

[11] Patent Number: 4,747,791

[45] Date of Patent: May 31, 1988

[54] ELECTRICAL JUNCTION BOX

[75] Inventor: Yukio Nishio, Shizuoka, Japan

[73] Assignee: Yazaki Corporation, Japan

[21] Appl. No.: 15,144

[22] Filed: Feb. 17, 1987

[30] Foreign Application Priority Data

Feb. 17, 1986 [JP] Japan ..... 61-20114[U]

[51] Int. Cl.[4] ..... H01R 25/12

[52] U.S. Cl. ..... 439/638

[58] Field of Search ..... 439/284, 289, 290, 535, 439/540, 638, 650, 651, 652, 654, 655

[56] References Cited

U.S. PATENT DOCUMENTS 4,477,136 10/1984 Smith ..... 439/289

*Primary Examiner*—Eugene F. Desmond

*Attorney, Agent, or Firm*—Wigman & Cohen

[57] ABSTRACT

A electrical junction box for use in electrical equipment for automotive vehicles, etc., has a junction box body and at least two box connectors for connecting wire harnesses to inner circuits of the junction box. Each of the at least two box connectors comprises at least one cable connector for directly connecting the remaining wire harness which are not connected to the junction box to each other. Both the box connectors and cable connectors are accomodated in the junction body box. The cable connectors are constructed so as to be connected to each other when the box connectors are engaged with the junction box body.

11 Claims, 4 Drawing Sheets

ELECTRICAL JUNCTION BOX

BACKGROUND OF THE INVENTION

1. Field of the Invention

The present invention relates generally to an electrical junction box such as connection box, relay box, etc. available with electrical equipment for automatic vehicles, for instance, and more specifically to an electrical junction box provided with box connectors for connecting wire harnesses to the junction box and a cable connector for connecting the remaining wire harnesses not connected to the junction box to each other.

2. Description of the Prior Art

The background of the present invention will be explained with respect to is application to the electrical junction box used with an automotive vehicle.

In automotive vehicles, a number of junction boxes are arranged for interconnecting a battery, switches, and various electrical equipment. In an ordinary electrical junction box, cable wires are connected to contact pins implanted in the junction box through some female box connectors (referred to as wire-to-box connection or connector, hereinafter). In addition, in many cases, the remaining wires are directly connected to the other remaining wires via an ordinary cable connector (referred to as wire-to-wire connection or connector, hereinafter) near the junction box.

Therefore, in servicing a vehicle for maintenance and repair, since a mechanic must perform the wire-to-box connection work and the wire-to-wire connection work separately, the work is troublesome. Further, since the wire-to-wire connectors are usually left to hang in the air near the junction box, abnormal noises may be produced when the vehicle is running, so that it is necessary to fix the wire-to-wire connectors to the junction box or a vehicle body. Furthermore, since the wire-to-wire connectors are exposed to the outside, there exists another problem such that the wire-to-wire connector should be formed in a waterproof fashion to prevent a waterdrop from permeating therein.

The arrangement of the prior-art electrical junction box will be described in more detail hereinafter with reference to the attached drawing under DETAILED DESCRIPTION OF THE PREFERRED EMBODIMENTS.

SUMMARY OF THE INVENTION

With these problems in mind, therefore, it is the primary object of the present invention to provide an electrical junction box by which all cable wires can be connectd to the junction box or other cable wires simultaneously within the junction box even when there exist some wires not connected to the junction box; that is, the wire-to-wire connection can also be made within the junction box simultaneously whenever wire-to-box connection is effected.

To achieve the above-mentioned object, the present invention provides the electrical junction box having a junction box body and at least two box connectors connectable to the junction box body in fitting engagement therewith to connect at least two cables to the junction box body separately, characterized in that the at-least two box connectors comprise at least one cable connector in combination for directly connecting the remaining wires of the two cables not connected to the junction box via the box connectors, within the junction box, when the box connectors are engaged with the junction box body.

The at-least two box connectors are (a) a first box connector formed with a male cable connector; and (b) a second box connector formed with a female cable connector connectable to the male cable connector when the first and second box connectors are both engaged with the junction box body.

In use, the first box connector formed with the male cable connector is first engaged with the junction box body, thereafter the second box connector formed with the female cable connector is engaged with the junction box body, then the female cable connector is engaged with the male cable connector.

Further, it is preferable to fix the box connectors to the junction box body by use of nuts and bolts for providing a better connection.

In the electrical junction box according to the present invention, the wire-to-wire connector for connecting cable wires not connected to the junction box to each other is incorporated with the wire-to-box connector for connecting cable wires to the junction box, it is possible to facilitate the connector engagement work; to fix the dangling wire-to-wire connector to the junction box; and to eliminate the need of manufacturing the wire-to-wire connector in waterproof fashion.

BRIEF DESCRIPTION OF THE DRAWINGS

The features and advantages of the electrical junction box according to the present invention over the prior-art junction box will be more clearly appreciated from the following description of the preferred embodiment of the invention taken in conjunction with the accompanying drawings in which like reference numerals designate the same or similar elements or sections throughout the figures thereof and in which.

DETAILED DESCRIPTION OF THE PREFERRED EMBODIMENTS

To facilitate understanding the present invention, a brief reference will be made to a prior-art electrical junction box, with reference to the attached drawing.

Figure 1:
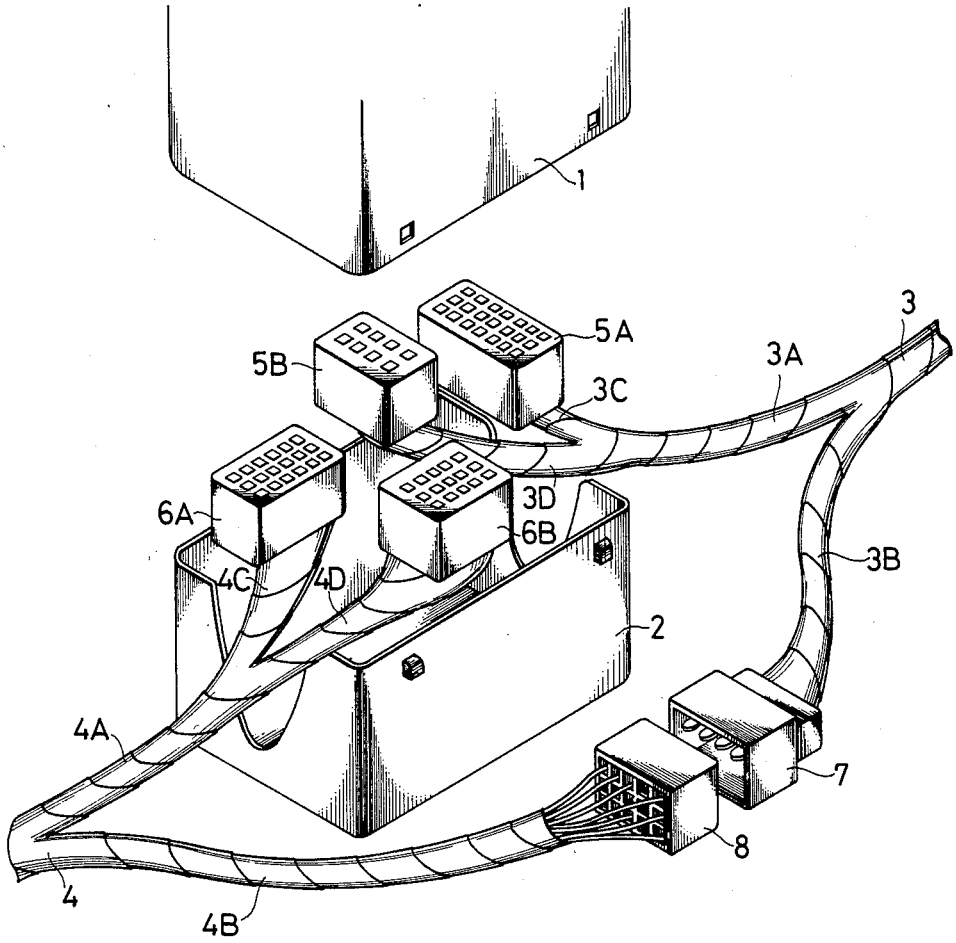
FIG.1 PRIOR ART
FIG. 1 is an exploded view showing a prior-art electrical junction box.

FIG. 1 shows a prior-art junction box. The junction box is made up of a junction box body 1, a box cover 2, and plural female box connectors 5A and 5B, 6A and 6B. A first cable 3 which is formed by rolling a bundle of many wires with tape is branched into two first branch cables 3A and 3B; while a second cable 4 is branched into two second branch cables 4A and 4B. The first branch cable 3A if further branched into two subbranch cables 3C and 3D; while the second branch cable 4A is further branched into two subbranch cables 4C and 4D.

The first two subbranch cables 3C and 3D are connected to the junction box body 1 via two first and second female box (wire-to-box) connectors 5A and 5B. Similary, the second two subbranch cables 4C and 4D are connected to the junction box body 1 via two third and fourth female box (wire-to-box) connectors 6A and 6B. That is to say, the two branch cables 3A and 4A are connected to the junction box body 1 via four bo (wire-to-box) connectors 5A, 5B, 6A and 6B, separately.

In addition, the first branch cable 3B is connected to the second branch cable 4B via an outer male cable connector 7 and an outer female cable connector 8 near and outside the junction box body 1 in a dangling state.

Therefore, the prior-art junction box involves several drawbacks as follows: The outer cable connectors 7 and 8 are not fixed to the junction box body 1 because the outer cable connector is left hanging in the air and therefore may be brought into contact with the junction box or other elements when vibrated; the outer cable connector must be of a waterproof and dustproof type because it is directly exposed to the outside; and the above-mentioned many connectors can not be connected at a single mechanics's operation.

In view of the above description, reference is now made to a first embodiment of the electrical junction box according to the present invention.

Figure 2:
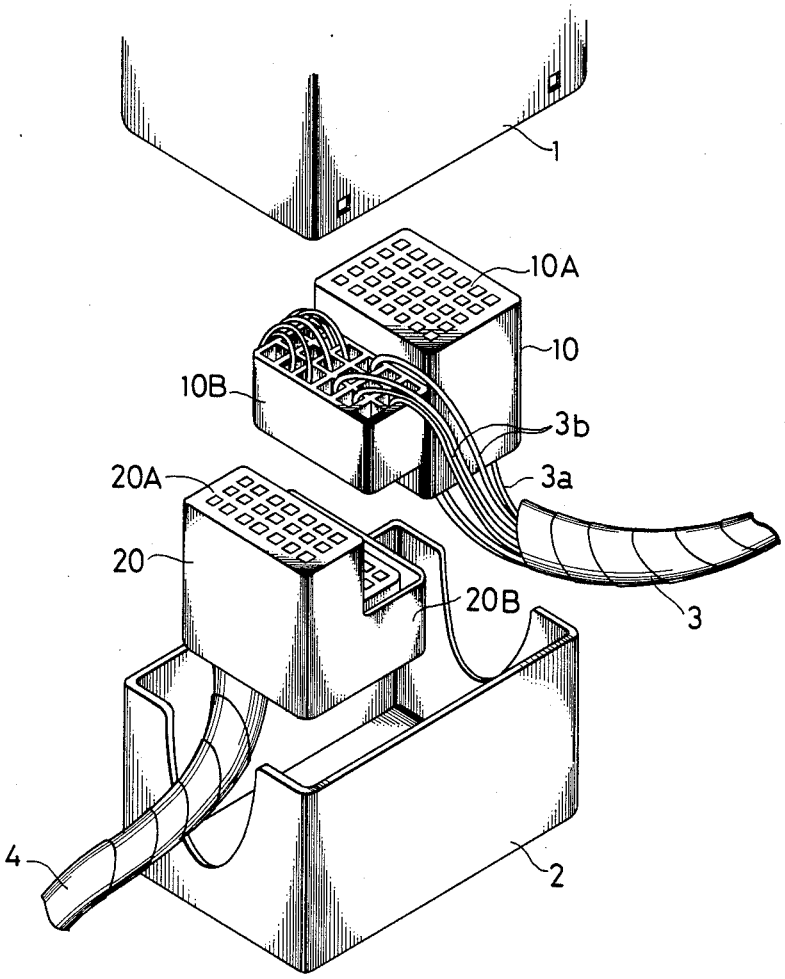
FIG. 2 is a similar exploded view showing a first embodiment of the electrical junction box according to the present invention.

With reference to FIG. 2, the junction box according to the present invention comprises a junction box body 1, a junction box cover 2, a first box connector 10 formed with a first female box connector 10A and a male cable connector 10B, and a second box connector 10 formed with a second female box connector 20A and a female cable connector 20B.

Figure 3:
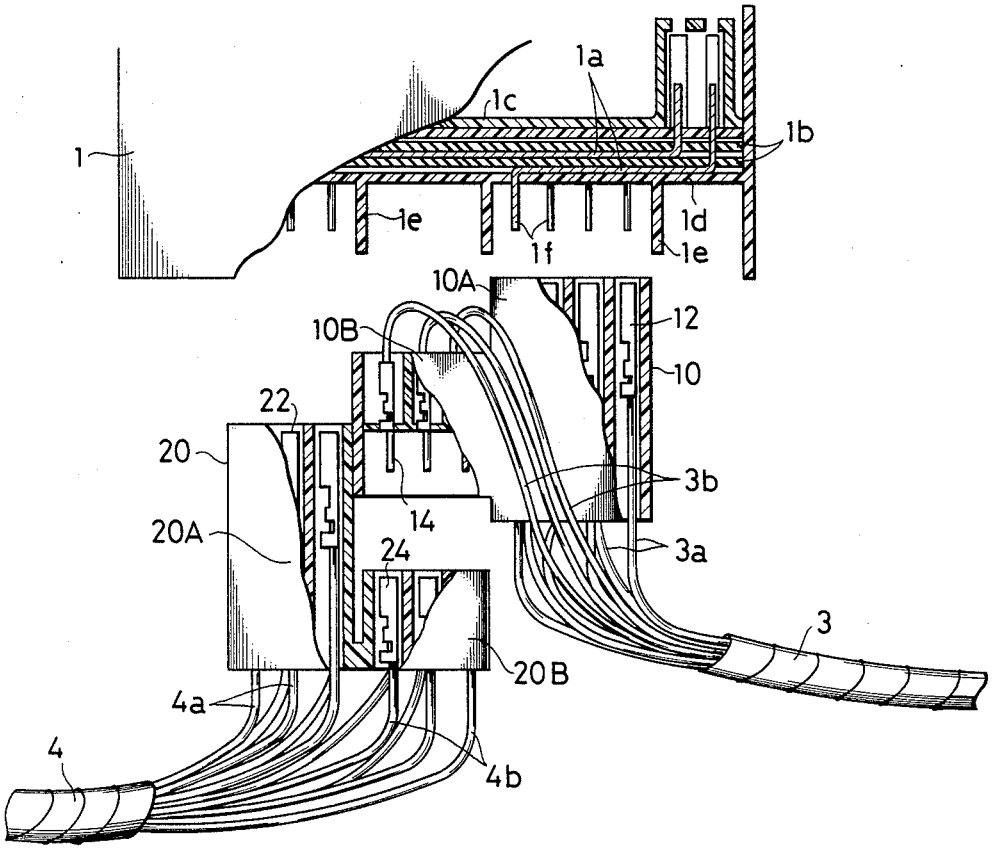
FIG. 3 is an enlarged cross-sectional view, partly broken, of the electrical junction box shown in FIG. 2.

With reference to FIG. 3, the junction box includes a plurality of bus bars **1*a* having any given circuit pattern, a plurality of insulating plates 1*b* for insulating one bus bar from the other bus bar so as to sandwich each bus bar 1*a* between two insulating plates 1*b*, an inner box plate 1*c*, and an outer box plate 1*d* formed with plural partitions 1*e*. Each end of the bus bar 1*a* is bent so as to extend outward through an appropriate hole formed in the outer box plate 1*d* as a connector pin 1*f*. The above partitions 1e are so provided as to locate the connection position of the first female box connector 10A, the male cable connector 10B, and the second female box connector 20A**.

The bus bars 1a are connectable to each other or connectable to an inner circuit disposed within the junction box or an outer circuit disposed outside the junction box.

Some wires **3*a* of the first cable 3 are connected to female connector terminals 12 of the first female box connector 10A, while the remaining wires 3*b* of the first cable 3 are connected to male connector terminals 14 of the male cable connector 10B in the connecting direction opposite to those of other wires. On the other hand, some wires 4*a* of the second cable 4 are connected to female connector terminals 22 of the second female box connector 20A; while the remaining wires 4*b* of the second cable 4 are connected to female connector terminals 24 of the female cable connector 20B. Therefore, the wires 3*a* are connectable to the junction box body 1 through the connector pins 1f of the junction box body 1 and the first female box connector 10A. Similarly, the wires 4*a* are connectable to the junction box body 1 through the connector pins 1f of the junction box body 1 and the second female box connector 20A. On the other hand, the wires 3*b* are connected to the wires 4*a* through the male cable connector 10B and female cable connector 20B** when both the connectors are engaged.

In connection, the first box connector 10 is first engaged with the junction box body 1 so that the first female box connector 10A is fitted to a space determined by the partitions **1*e*. Subsequently, the second box connector 20 is engaged with the junction box body 1 in the same way so that the female cable connector 20B can be engaged with the male cable connector 10B** at the same time.

In the first and second box connectors 10 and 20 shown in FIG. 3, the male cable connector 10B is formed integral with the first box connector 10A and the female cable conector 20B is formed integral with the second box connector 20A. Without being limited thereto, however, it is possible to form the female cable connector integral with the first box connector 10A and to form the male cable connector integral with the second box connector 20A. Further, it is of course possible to reverse the engagement sequence of the two box connectors 10 and 20. In this case, the box connector 20 formed with a cable connector as shown by 10B is first engaged with the junction box body 1, and then the box connector 10 formed with a cable connector as shown by 20B is engaged with the junction box body 1.

Figure 4:
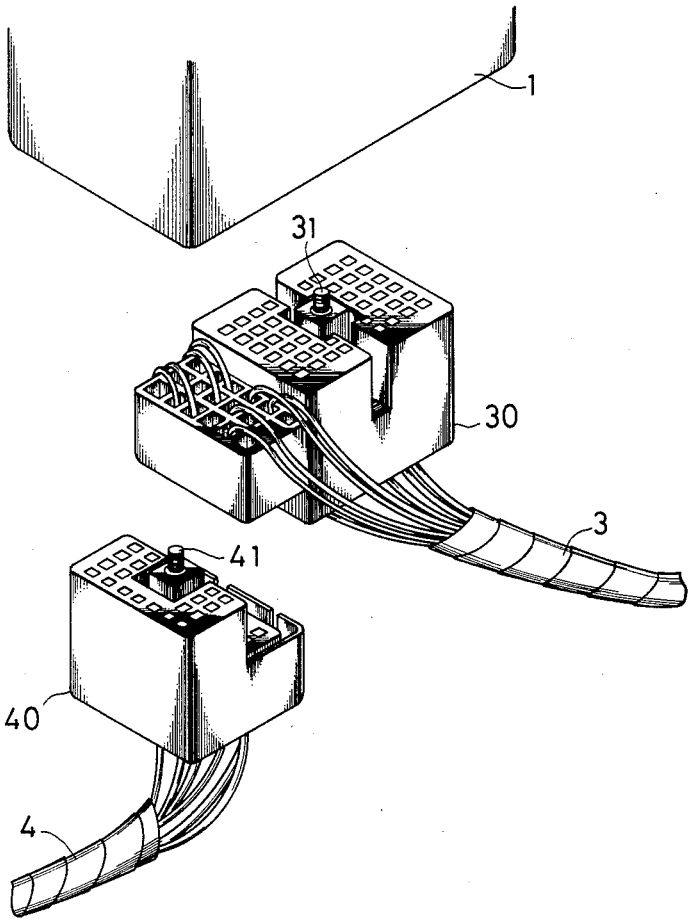
FIG. 4 is an exploded view showing a second embodiment of the electrical junction box according to the present invention.

FIG. 4 shows a second embodiment of the junction box according to the present invention. In this embodiment, a first bolt 31 is loosely engaged with a through hole formed roughly at the center of a first female box connector 30; a second bolt 41 is also loosely engaged with a through hole formed roughly at the center of a second box connector 40. These bolts are temporarily supported by the connectors 30 and 40, separately, by use of a retainer, for instance. These bolts 31 and 41 are fastened to nuts fixed to the inner wall surface of the junction box body 1 or fixed being passed through the wall surface of the junction box body 1.

The second embodiment shown in FIG. 4 is effective in particular when the number of wires to be connected is great, because a relatively great force is required to engage the box connectors 30 and 40 with the junction box body 1. On the other hand, when the box connectors 30 and 40 are firmly fixed to the junction box body 1, it is possible to securely prevent misalignment between the connectors and the junction box body.

In the above embodiments, only two box connectors formed with two cable connectors, separately have been explained. However, without being limited thereto, it is possible to embody the junction box according to the present invention in such a way that three or more box connectors are engaged with the junction box body and further two or more cable connector are each formed integral with each box connector so as to be engaged with the box connectors are all connected to the junction box body.

As described above, according to the present invention, since the electrical junction box according to the present invention is provided with two box connectors for connecting wires to an inner circuit of the junction box, and male and female cable connectors (wire-to-wire connector) for connecting the remaining wires not directly related to the inner circuit of the junction box are each formed integrally on the box connector, it is possible to engage the male and female cable connectors simultaneously when the box connectors are engaged with the junction box body, thus improving the ability of the mechanic to make the connection, allowing the two cable connectors to be fixed to the junction box, and averting the need of a waterproof cable connector.

What is claimed is:

1. An electrical junction box having a junction box body and at least two box connectors connectable to the junction box body in fitting engagement therewith to separately connect at least two cables to the junction box body, wherein each of said at least two box connectors comprises at least one cable connector for directly connecting the remaining wires of the two cables which are not connected to the junction box within the junction box, and the cable connectors are connected to each other when said box connectors are engaged with the junction box body.

2. The electrical junction box as set forth in claim 1, wherein said at least two box connectors are:

(a) a first box connector formed with a male cable connector; and (b) a second box connector formed with a female cable connector connectable to said male cable connector when said first and second box connectors are both engaged with the junction box body.

3. The electrical junction box as set forth in claim 2, wherein each of said cable connectors is intergrally on each box connector.

4. The electrical junction box as set forth in claim 2, wherein said first box connector is formed with the male cable connector facing opposite the direction its box connector engages the junction box body, and said second box connector is formed with the female cable connector facing in the same direction as its box connector.

5. The electrical junction box as set forth in claim 2, wherein said second box connector is formed with the female cable connector facing opposite the direction of the junction box body, and said first box connector is formed with the male cable connector facing in the same direction as the junction box body.

6. The electrical junction box as set forth in claim 1, wherein said at least two box connectors are each fixed to said junction box body by use of a nut and a bolt.

7. The electrical junction box as set forth in claim 6, wherein said bolt is passed through said box connector and said nut is fixed to said junction box body.

8. The electrical junction box as set forth in claim 1, wherein said at least two box connectors including said at least one cable connector are housed within junction box body with a box cover to protect the connectors from water and dust.

9. An electrical junction box comprising:

a junction box body;

a plurality of wire-to-box box connectors connectable to the junction box body to separately connect a plurality of cables to the junction box body;

a male wire-to-wire connector fixed to a first of said wire-to-box box connectors;

a female wire-to-wire connector fixed to a second of said wire-to-box connectors;

wherein when said first and second wire-to-box connectors are connected to said junction box body to connect said plurality of cables to the junction box body, said male and female wire-to-wire connectors are mated to form a wire-to-wire connection therebetween.

10. The electrical junction box of claim 9 wherein said male wire-to-wire connector is integrally formed on said first wire-to-connector and said female wire-to-wire connector is integrally formed on said second wire-to-box box connector.

11. The electrical junction box of claim 10 further comprising a box cover mating with said junction box body.

* * * * *

UNITED STATES PATENT AND TRADEMARK OFFICE

CERTIFICATE OF CORRECTION

PATENT NO. : 4,747,791

DATED : May 31, 1988

INVENTOR(S) : YUKIO NISHIO

It is certified that error appears in the above-identified patent and that said Letters Patent is hereby corrected as shown below:

IN THE SPECIFICATION:

Column 1, line 16, "is" should be --its--;

Column 3, line 4, "bo" should be --box--;

line 28, "10" should be --20--.

IN THE CLAIMS:

Claim 3, line 2, "intergrally" should be --integrally formed--.

Claim 8, line 3, after "within" insert --the--.

Claim 9, line 9, after "wire-to-box" insert --box--.

Claim 10, line 3, "wire-to-connector" should be --wire-to-box connector--.

Signed and Sealed this

Thirteenth Day of December, 1988

*Attest:*

DONALD J. QUIGG

*Attesting Officer*

*Commissioner of Patents and Trademarks*